US006929455B2

(12) United States Patent
Dreiman et al.

(10) Patent No.: US 6,929,455 B2
(45) Date of Patent: Aug. 16, 2005

(54) HORIZONTAL TWO STAGE ROTARY COMPRESSOR

(75) Inventors: Nelik I. Dreiman, Tipton, MI (US); Rick L. Bunch, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 311 days.

(21) Appl. No.: 10/271,268

(22) Filed: Oct. 15, 2002

(65) Prior Publication Data

US 2004/0071570 A1 Apr. 15, 2004

(51) Int. Cl.[7] ..... F04B 17/00; F04B 49/00; F04B 24/00; F01C 1/30; F01C 1/02

(52) U.S. Cl. ..... 417/410.3; 417/242; 417/250; 417/902; 418/5; 418/63; 418/186

(58) Field of Search ..... 417/199.1, 348, 417/349, 350, 410.3, 902, 250, 246, 360, 359, 242; 418/5, 60, 63, 64, 65, 88, 186; 184/6, 6.16; 92/61, 153; 62/89, 510, 117, 270; 418/93, 96, 249, 267

(56) References Cited

U.S. PATENT DOCUMENTS

| | | | | | |
|---|---|---|---|---|---|
| 2,102,345 | A | * | 12/1937 | Wishart | 418/11 |
| 2,898,032 | A | * | 8/1959 | Katzenberger | 417/244 |
| 3,178,102 | A | | 4/1965 | Grisbrook | 230/139 |
| 5,094,085 | A | | 3/1992 | Irino | 62/175 |
| 5,100,308 | A | | 3/1992 | Gevelhoff et al. | 418/30 |
| 5,242,280 | A | | 9/1993 | Fujio | 418/11 |
| 5,314,318 | A | | 5/1994 | Hata et al. | 418/60 |
| 5,322,424 | A | | 6/1994 | Fujio | 418/11 |
| 5,326,233 | A | | 7/1994 | Mochizuki et al. | 417/350 |
| 5,328,344 | A | | 7/1994 | Sato et al. | 418/85 |
| 5,372,489 | A | | 12/1994 | Matsuda et al. | 418/13 |
| 5,542,831 | A | | 8/1996 | Scarfone | 418/60 |
| 5,579,651 | A | | 12/1996 | Sugiyama et al. | 62/469 |
| 5,586,876 | A | | 12/1996 | Yasnnascoli et al. | 418/60 |
| 5,775,883 | A | | 7/1998 | Hattori et al. | 417/310 |
| 5,879,138 | A | | 3/1999 | Arndt et al. | 417/244 |
| 6,086,347 | A | | 7/2000 | Ryska et al. | 418/212 |
| 6,189,335 | B1 | | 2/2001 | Ebara et al. | 62/510 |
| 6,267,572 | B1 | | 7/2001 | Suefuji et al. | 418/5 |
| 6,270,329 | B1 | | 8/2001 | Oshima et al. | 418/63 |
| 6,290,472 | B2 | | 9/2001 | Gannaway | 417/371 |
| 6,318,981 | B1 | | 11/2001 | Ebara et al. | 418/11 |
| 6,336,799 | B1 | | 1/2002 | Matsumoto et al. | 418/60 |
| 2002/0187051 | A1 | * | 12/2002 | Maier et al. | 417/203 |

FOREIGN PATENT DOCUMENTS

| | | | | |
|---|---|---|---|---|
| EP | WO0116490 | | 3/2001 | |
| JP | 2001-73976 | * | 3/2001 | F04C/23/00 |

* cited by examiner

*Primary Examiner*—Cheryl Tyler
*Assistant Examiner*—Timothy P. Solak
(74) *Attorney, Agent, or Firm*—Baker & Daniels

(57) ABSTRACT

A hermetic two stage rotary compressor having a housing with a stationary shaft fixedly mounted in the housing. A motor having a rotor and a stator is mounted in the housing with the rotor being rotatably mounted on the shaft. A pair of compression mechanisms are rotatably mounted on the shaft with one compression mechanism being located adjacent a first end of the rotor, and one compression mechanism being located adjacent a second end of the rotor. The compression mechanisms are operatively associated with the rotor such that rotation of the rotor drives the compression mechanisms. A fluid flow path is defined in the compressor including a plurality of longitudinal bores formed in the stationary shaft. A mounting assembly is attached to the housing so as to mount the compressor in either a substantially horizontal or vertical orientation. The pump is positioned so as to be at least partially immersed in an oil sump in the housing when the compressor in either orientation.

24 Claims, 9 Drawing Sheets

HORIZONTAL TWO STAGE ROTARY COMPRESSOR

BACKGROUND OF THE INVENTION

The present invention relates to hermetic compressors and more particularly to two stage rotary compressors using carbon dioxide as the working fluid.

Conventionally, multi-stage compressors are ones in which the compression of the refrigerant fluid from a low, suction pressure to a high, discharge pressure is accomplished in more than one compression process. The types of refrigerant generally used in refrigeration and air conditioning equipment include chlorofluorocarbons (CFCs) and hydrochlorofluorocarbons (HCFCs). Additionally, carbon dioxide may be used as the working fluid in refrigeration and air conditioning systems. By using carbon dioxide refrigerant, ozone depletion and global warming are nearly eliminated. Carbon dioxide is non-toxic, non-flammable, and has better heat transfer properties than CFCs and HCFCs, for example. The cost of carbon dioxide is significantly less than CFC and HCFC. Additionally, it is not necessary to recover or recycle carbon dioxide, which contributes to significant cost savings in training and equipment.

In a two-stage compressor, the suction pressure gas is first compressed to an intermediate pressure. The intermediate pressure gas is then generally collected in an accumulator. From the accumulator, the intermediate pressure gas is drawn into a second compressor mechanism where it is compressed to a higher, discharge pressure for use in the remainder of the refrigeration system.

The compression mechanisms of the two-stage compressor may be in one of two orientations. The compression mechanisms may be stacked adjacent one another on one side of the motor, or positioned with one compression mechanism located on opposite sides of the motor. When the compression mechanisms are located adjacent one another, on one side of the motor, problems may occur during compressor operation. Such problems may include overheating of the suction gas supplied to the first stage compression mechanism which affects volumetric efficiency of the compressor performance. Heat transfer from the discharge pressure pipe heats the incoming suction pressure gas due to the close proximity of the pipes. Further, overheating due to the closeness of the compression mechanisms may create problems including additional reduction of the compressor efficiency and possible reliability issues.

In general, the compressor motor is located within the compressor housing and is surrounded by either suction pressure gas, or cooled intermediate pressure gas, which cools the motor during compressor operation. The suction pressure gas or cooled intermediate pressure gas surrounding the motor is then supplied to the second stage compression mechanism. If the suction or cooled intermediate pressure gas is overheated as discussed above, the motor and the gas entering the second stage compression mechanism may not be sufficiently cooled.

Alternatively, the pair of adjacent compression mechanisms may have parallel compressor operation. The suction pressure gas is drawn into both compression mechanisms simultaneously. If, for example, alternative refrigerants are used and the compression mechanisms are in a parallel configuration, the compression mechanisms may be unable to withstand the high operating pressure experienced during compression of some refrigerants such as carbon dioxide.

Additionally, locating the pair of compression mechanisms on opposite ends of the motor requires two drive shafts operatively driven by the motor. The drive shafts have to be precisely aligned and interconnected. The slightest misalignment of the drive shafts will result in dynamic instability. Misalignment of the shafts may also increase the load on the eccentrics, outboard bearings, and main bearings of the compression mechanisms, which in turn will trigger excessive vibration and noise during compressor operation. High pressures and large differences between the suction and discharge pressures will increase the load acting on the drive shafts, which is in turn transferred to bearings. The excess loads may cause premature failure of the bearings.

Some compressors have an eccentric mounted to each end of the shaft being fixedly secured thereto by, e.g., interference fit or a fastener such as a set screw. By providing the compressor with an eccentric that is an independent component from the drive shaft, assembly of the compressor may be complicated. Further, vibration and thus noise may be produced from the eccentric and drive shaft assembly if, for example, the eccentric becomes loose on the shaft.

It is desired to provide a rotary compressor with improved efficiency and reliability having a pair of compression mechanisms located at opposite ends of a drive shaft, operatively driven by the rotor, and improved refrigerant fluid flow through the compressor.

SUMMARY OF THE INVENTION

The present invention relates to a two stage rotary compressor which uses carbon dioxide refrigerant as the working fluid. The rotary compressor has a non-rotating or stationary shaft with opposite ends thereof fixedly mounted to the compressor housing. A pair of rotary compression mechanisms are rotatably disposed about opposite ends of the stationary shaft and are fixed to one another via an interference fit between the compression mechanisms and the central bore of the compressor motor rotor. Each compression mechanism includes a roller rotatably disposed on an eccentric integrally formed on the stationary shaft. Each roller has a vane integrally formed therewith which slidably engages a slot formed in a bushing mounted in the compression mechanism cylinder.

The stationary shaft is provided with a first longitudinal gas bore through which suction pressure gas travels into the first stage compressor assembly. The first gas bore is in communication with a peripheral channel formed between the stationary shaft and roller. Gas in the channel is supplied to the first stage compression chamber via a radial inlet passage formed in the roller, adjacent one side of the vane. Gas compressed in the first stage compression mechanism to an intermediate pressure exits the compression chamber via an outlet passage located adjacent a second side of the vane, opposite the inlet passage side. The compressed gas is received in a recess formed in the stationary shaft and in communication with a second longitudinal bore formed in the shaft. The compressed gas is exhausted through the second bore and an outlet fitting to a cooler. The cooled, intermediate pressure gas reenters the compressor housing through an inlet fitting to fill the motor chamber, thus cooling the motor. The cooled, intermediate pressure gas is drawn into the second stage compression mechanism through a passage in an outboard bearing located adjacent the compression mechanism and is compressed to a discharge pressure. The compressed gas is then exhausted from the compressor through a radial passage in the roller, adjacent one side of the vane. The gas then enters a recess and radial passage formed in the stationary shaft. The radial passage directs the gas to a third longitudinal bore in the shaft and through a discharge fitting mounted in the housing to the refrigeration system.

The compressor also has a stamped steel base which is contoured to the shape of the outer surface of the compressor housing. The base is secured to the housing by any suitable method including projection welding. The base is provided with a large opening which facilitates painting of the majority of the compressor housing surface. Holes are provided in the base which allows the compressor to be mounted to either a substantially horizontal or vertical grounding surface.

The present invention provides a hermetic rotary compressor including a housing having a stationary shaft fixedly mounted therein. A motor is also mounted in the housing and has a rotor and a stator. The rotor has a first and second end and is rotatably mounted on the shaft. First and second compression mechanisms are rotatably mounted on the shaft with the first compression mechanism located adjacent the first end of the rotor and the second compression mechanisms located adjacent the second end of the rotor. The compression mechanisms are operatively engaged with the rotor such that rotation of the rotor drives the compression mechanisms about the stationary shaft.

The present invention also provides a hermetic rotary compressor having a housing with a stationary shaft fixedly mounted in the housing. The stationary shaft has a first and second end. A motor having a stator and a rotor is mounted in a motor chamber defined in the housing. The rotor has opposite ends and is rotatably mounted about the stationary shaft. First and second stage compression mechanisms are provided, being fixed to opposite ends of the rotor. A first longitudinal bore extends from the first end of the stationary shaft to the first stage compression mechanism and is in fluid communication with the first stage compression mechanism via a first radial passage. A second radial passage extends between the first stage compression mechanism and a second longitudinal bore formed in the stationary shaft. The second longitudinal bore has a discharge port in fluid communication with the motor chamber. The motor chamber and the second stage compression mechanism are in fluid communication. The second stage compression mechanism is in fluid communication with a third longitudinal bore formed in the stationary shaft via a third radial passage. The third longitudinal bore extends from the second stage compression mechanism to the second end of the stationary shaft such that compressed refrigerant is exhausted from the compressor through the stationary shaft second end.

The present invention further provides a hermetic rotary compressor including a housing having an outer surface and an oil sump defined therein. A stationary shaft is fixedly mounted in the housing. A motor is mounted in the housing. The motor has a stator and a rotor with the rotor being rotatably mounted about the stationary shaft. First and second compression mechanisms are rotatably mounted at opposite ends of the rotor and are operatively engaged with the rotor. A mounting plate is attached to the outer surface of the housing such that the compressor is mounted in one of a substantially horizontal and vertical orientation.

One advantage of the present invention is that the compression mechanisms being linked and driven by the rotor eliminates the need for a pair of precisely aligned and interconnected drive shafts to drive the compression mechanisms, thus reducing the load on the shaft.

A further advantage of the present invention is that the compressor may be mounted to either a substantially horizontal or vertical grounding surface without requiring a different mounting assembly.

An additional advantage of the present invention is that the eccentrics are integrally formed with the stationary shaft, thereby reducing the number of compressor parts and simplifying assembly.

BRIEF DESCRIPTION OF THE DRAWINGS

The above-mentioned and other features and objects of this invention, and the manner of attaining them, will become more apparent when the invention itself will be better understood by reference to the following description of an embodiment of the invention taken in conjunction with the accompanying drawings, wherein.

Figure 1:
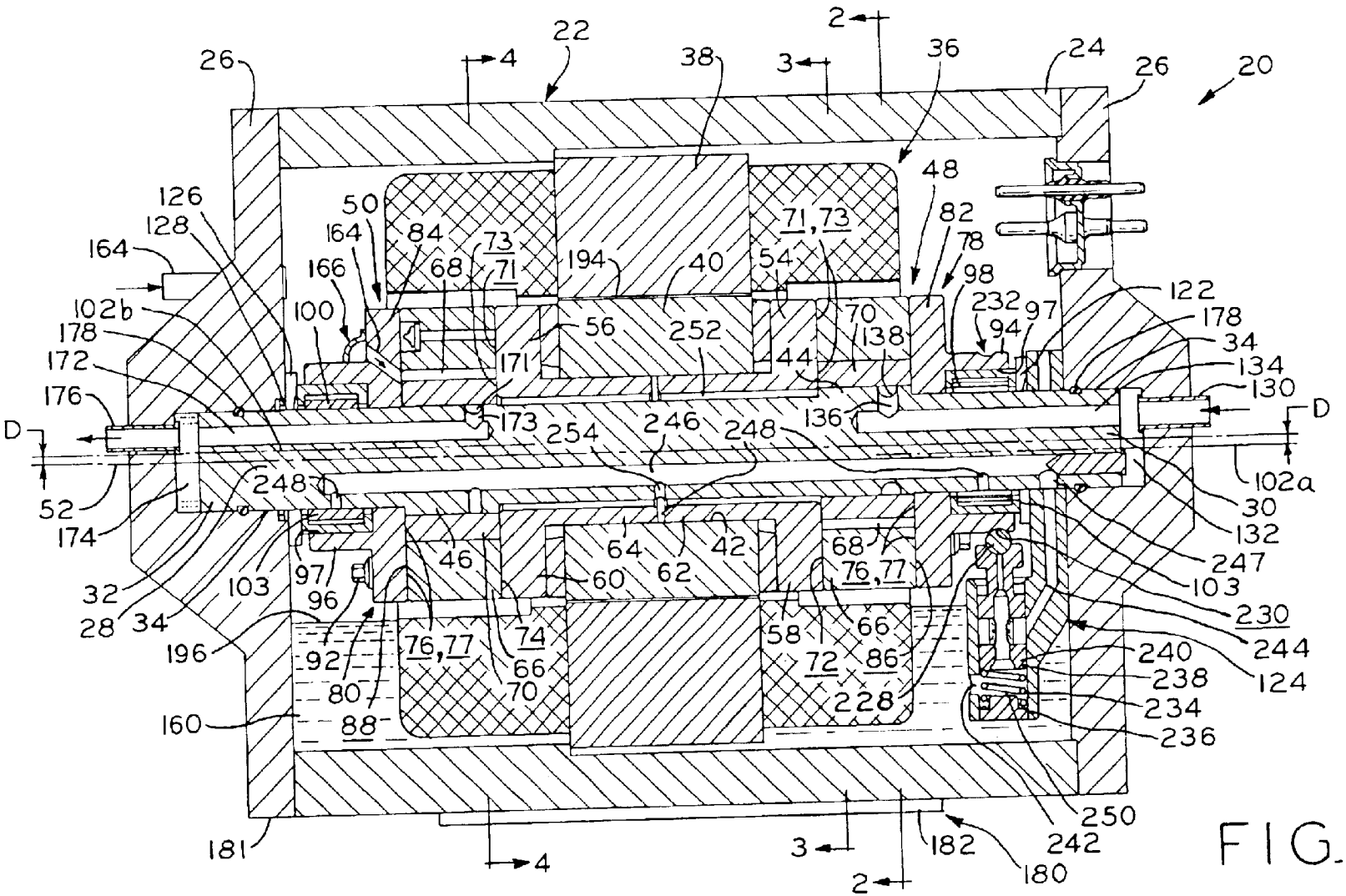
FIG. 1 is sectional view of a rotary compressor in accordance with the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Referring to FIG. 1, two-cylinder, two stage rotary horizontal compressor 20 for use in a refrigeration system. Compressor 20 includes hermetically sealed housing 22 defined by main body portion 24 having end caps 26 mounted to each end thereof by any suitable method including welding, brazing, or the like. Mounted within compressor housing 22 is non-rotating, stationary shaft 28 having opposite ends 30 and 32 mounted in recesses 34 formed in each end cap 26. Located in main body portion 24 of compressor housing 22 is electric compressor motor 36 including stator 38 and rotor 40. Stator 38 is, e.g., interference or shrink fitted in main body portion 24 to mount motor 36 therein and is rigidly mounted in surrounding relationship of rotor 40. Rotor 40 is provided with central aperture 42 extending the length thereof in which shaft 28 is received such that rotor 40 is rotatably disposed about the stationary shaft.

Eccentrics 44 and 46 are integrally formed near opposite shaft ends 30 and 32, respectively, and are engaged by first stage and second stage rotary compression mechanisms 48 and 50. Eccentrics 44 and 46 are formed on shaft 28 such that one eccentric 44 or 46 is located about longitudinal axis 52 of shaft 28 approximately 180° from the other eccentric 44 or 46 to ensure proper balance of compression mechanisms 48 and 50. Each of the first and second stage compression mechanisms 48 and 50 are provided with heads 54 and 56 having annular flanges 58 and 60, respectively, with substantially cylindrical projections 62 and 64 extending therefrom. Heads 54 and 56 are mounted on rotor 40 for rotation therewith with projections 62 and 64 being secured to rotor 40 by, e.g., press fitting or shrink fitting such that flanges 58 and 60 are held tightly against opposite ends of rotor 40.

Referring to FIGS. 1 through 4, first and second stage compressing mechanisms 48 and 50 include cylinder block 66 having inner cylindrical cavity 68 defined between the inner surface of inner cylinder block 66 and each of eccentrics 44 and 46. One roller 70 is located in each cavity 68 in surrounding relationship of eccentric 44 and 46, being journaled thereon. Cylinder block 66 rotates with rotor 40 and roller 70 in the direction of arrow 67 (FIGS. 2, 3, and 4) about eccentrics 44 and 46. There is sealing contact between the roller eccentric assembly and cavity 68 in cylinder block 66 to provide radial fluid sealing at the points where roller 70 engages the inner wall of cylinder block 66. Referring to FIG. 1, each of the cylinder blocks 66 and rollers 70 has an end surface 71 and 73, respectively. End surfaces 71 and 73 of each compression mechanism 48 and 50 are in abutting contact with surfaces 72 and 74 of head flanges 58 and 60, respectively. Outboard bearings 78 and 80 are provided with annular flanges 82 and 84 having surfaces 86 and 88 which are in abutting contact with opposite end surfaces 76 and 77 of each cylinder block 66 and roller 70, respectively. Apertures are provided in flanges 82 and 84 which align with oversized apertures 90 (FIGS. 2, 3 and 4) provided through cylinder block 66 and threaded apertures (not shown) in flanges 58 and 60. Fasteners 92 extend through the aligned apertures, threadedly engaging flanges 58 and 60 to interconnect outboard bearings 78 and 80, cylinder blocks 66, and heads 54 and 56 of respective compression mechanisms 48 and 50.

Upon assembly of heads 54, 56, cylinder blocks 66, and outboard bearings 78 and 80, there is an inherent eccentricity between the cylinder block inner diameter and roller outer diameter. The eccentricity might cause the interference fit between cylinder block 66 and roller 70 to be greater than intended in one portion of the roller orbit and less than intended in the opposite portion of the roller orbit. This may induce high internal stresses in roller 70 and the connecting compressor components which may lead to premature fatigue failure. To address this potential issue and prevent premature failure in the inventive compressor, apertures 90 in cylinder block 66 are oversized, allowing the cylinder block to be located during compressor assembly so that the preliminary interference fit is predetermined. In one example, the interference fit is in the range of 0.0005 to 0.0007 inches, however, this range may vary with the size of the compressor.

Referring to FIG. 1, ends 30 and 32 of stationary shaft 28 extend through outboard bearings 78 and 80, respectively. Outboard bearings 78 and 80 have projections 94 and 96 integrally formed therewith, extending from flanges 82 and 84 toward end caps 26. Cavity 97 is defined between each projection 94 and 96 and shaft 28 in which needle bearing assemblies 98 and 100 are located, being press-fit therein. Bearing assemblies 98 and 100 include a plurality of respective needle bearing elements 103 which rotate on the outer surface of shaft 28. The centerline axis of bearing assemblies 98 and 100 is concentric with longitudinal axis 52 while projections 94 and 96 have centerline axes 102*a* and 102*b* which are offset from shaft axis 52 by distance D. This allows projections 94 and 96 to rotate eccentrically about longitudinal axis 52 of stationary shaft 28.

Figure 5:
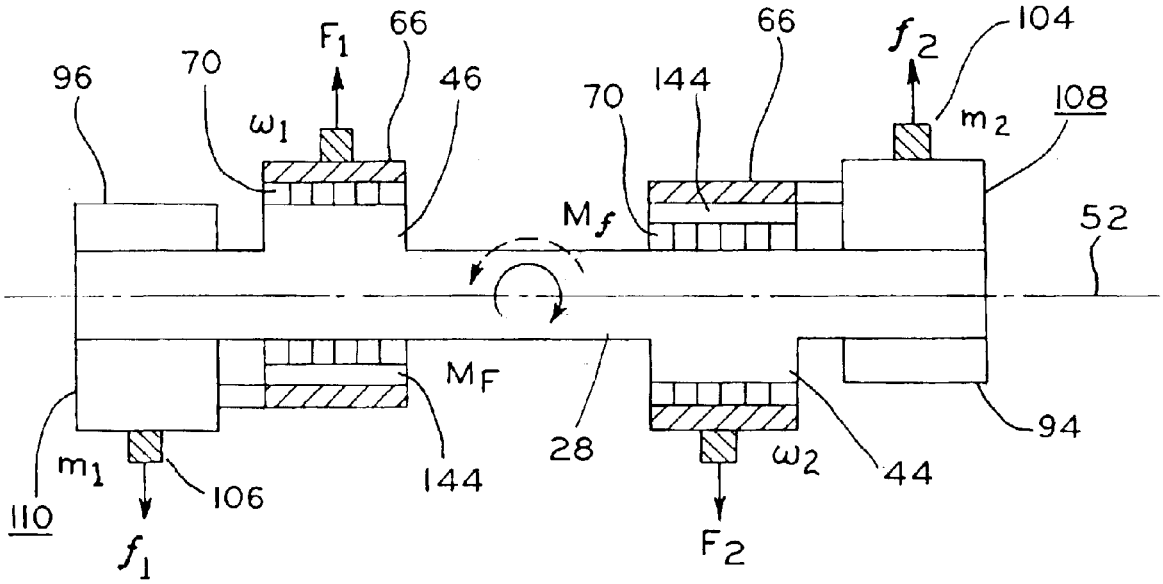
FIG. 5 is a schematic view of the stationary shaft and eccentrics of the rotary compressor of FIG. 1.

Referring to FIG. 5, eccentric portions of projections 94 and 96 have balance adjusting parts 104 and 106 which are positioned on opposite sides of shaft 28 having a 180° phase difference about shaft center axis 52. Balance adjusting part 104 is positioned on shaft 28 approximately 180° from eccentric 44, and balance adjusting part 106 is positioned approximately 180° from eccentric 46. Inertia forces $F_1$ and $F_2$ are respectively produced at eccentrics 44 and 46 upon rotation of the cylinder blocks 66 and thus outboard bearings 78 and 80. The inertia forces create inertia couple $M_F$ centrally along the length of shaft 28 and about an axis perpendicular to shaft axis 52. Balance adjust parts 104 and 106 produce inertia forces $f_1$ and $f_2$ upon rotation of cylinder blocks 66 and thus outboard bearings 78 and 80, thereby producing inertia couple $M_F$ at the same position on shaft 28 as $M_F$. Inertia couple $M_F$ is equivalent to inertia couple $M_F$ however, $M_F$ acts in an opposite direction to that of $M_F$ due to the fact that the direction of forces $f_1$ and $f_2$ is opposite to that of forces $F_1$ and $F_2$. Therefore, the inertia couple $M_F$ is counterbalanced by inertia couple $M_f$ and the shaft assembly is balanced as a whole. Additionally, counterweights (not shown) may be provided adjacent to opposite surfaces 108 and 110 of the corresponding outboard bearings 78 and 80 to further aid in balancing of compressor assembly 20.

Compressor 20 is mounted in a substantially horizontal orientation by external mounting plate 180 shown in FIGS. 2–4, 7A, 7B, 8A, and 8B. Mounting plate 180 is attached to outside wall 181 of compressor 20 by any suitable method including, e.g., projection welding which reduces the amount of time required for compressor assembly. Referring to FIGS. 7A, 7B, 8A, and 8B, external mounting plate 180 is an integral unit including base 182 having extension legs 184 extending therefrom. Each extension leg 184 is provided with hole 186 for mounting compressor 20 to a flat supporting surface (not shown) such as the floor or wall of a building or refrigeration system housing. Base 182 is contoured to match the curvature of compressor outside wall 181 and is formed having opening 188 which allows for positioning and handling of mounting plate 180 during assembly. Opening 188 also reduces the amount of area of compressor housing 22 covered by base 182 allowing more of outside housing wall 181 to be painted for rust protection purposes. Base 182 includes a plurality of welding projections 190 which are used to weld external mounting plate 180 to compressor outside wall 181. Although base 182 is shown having six welding projections 190, additional projections or alternative fastening mechanisms may be used to secure mounting plate 180 to compressor housing 22. Holes 192 are provided in opposite extension legs 184 which are used for a grounding connection for compressor 20. Compressor 20 may be mounted on either of a horizontal or vertical grounding surface using mounting plate 180. In order for compressor 20 to be mounted on a substantially vertical grounding surface, oil pump 124, located near end 30 of shaft 28, is kept at least partially immersed in motor and oil sump cavity 160 and oil has to be prevented from entering motor rotor stator gap 194.

Figure 2:
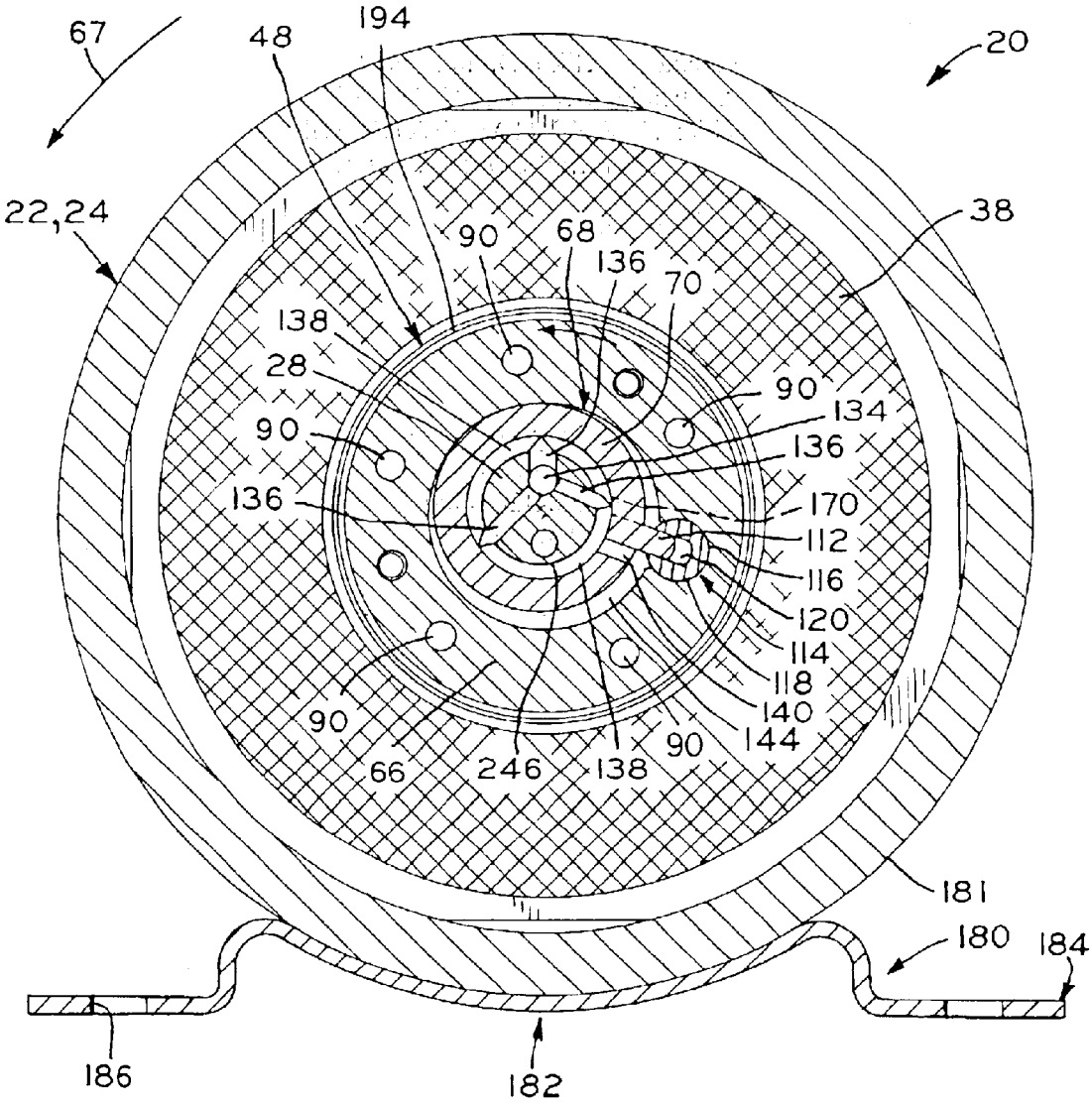
FIG. 2 is a sectional view of the rotary compressor of FIG. 1 along line 2—2.
Figure 3:
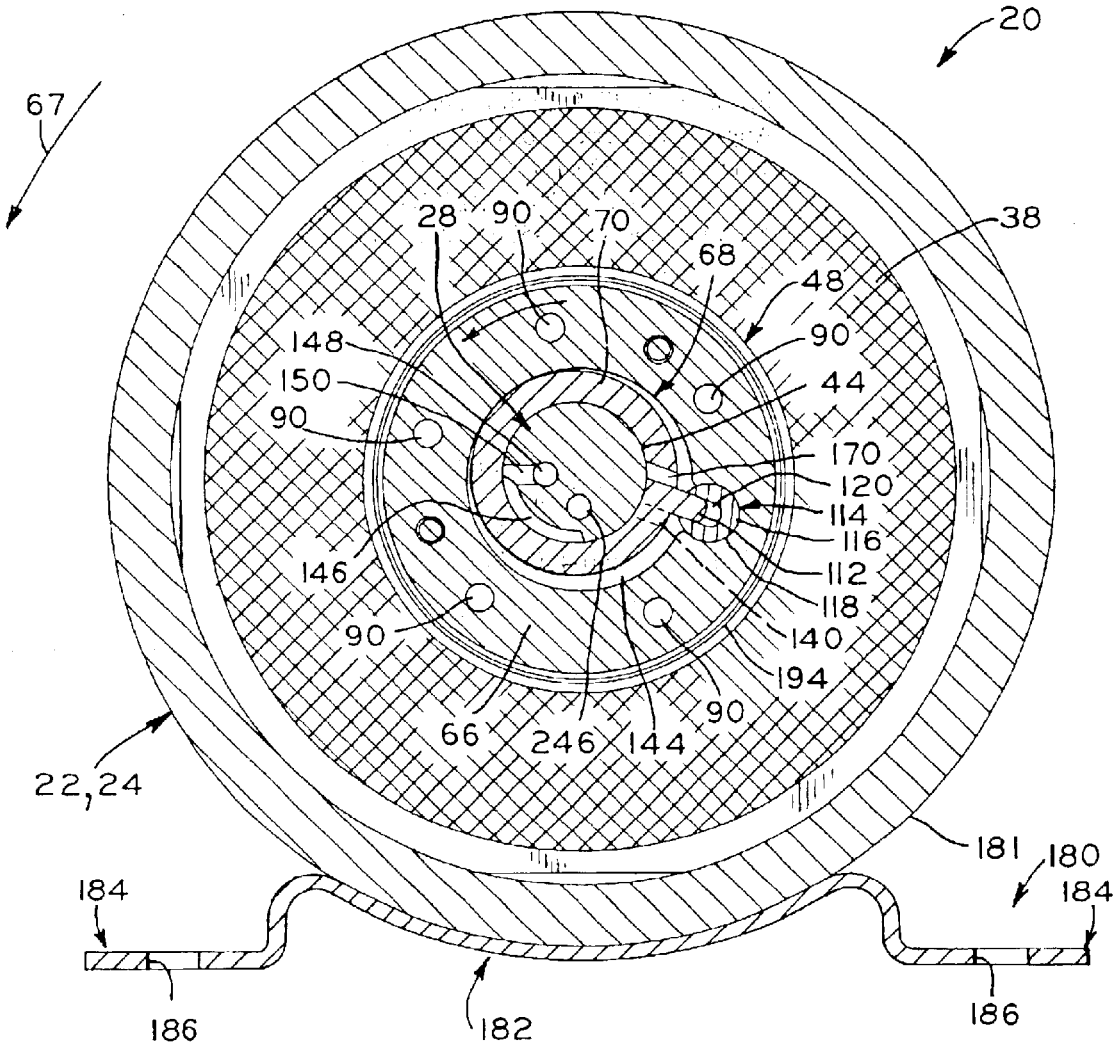
FIG. 3 is a sectional view of the rotary compressor of FIG. 1 along line 3—3.
Figure 4:
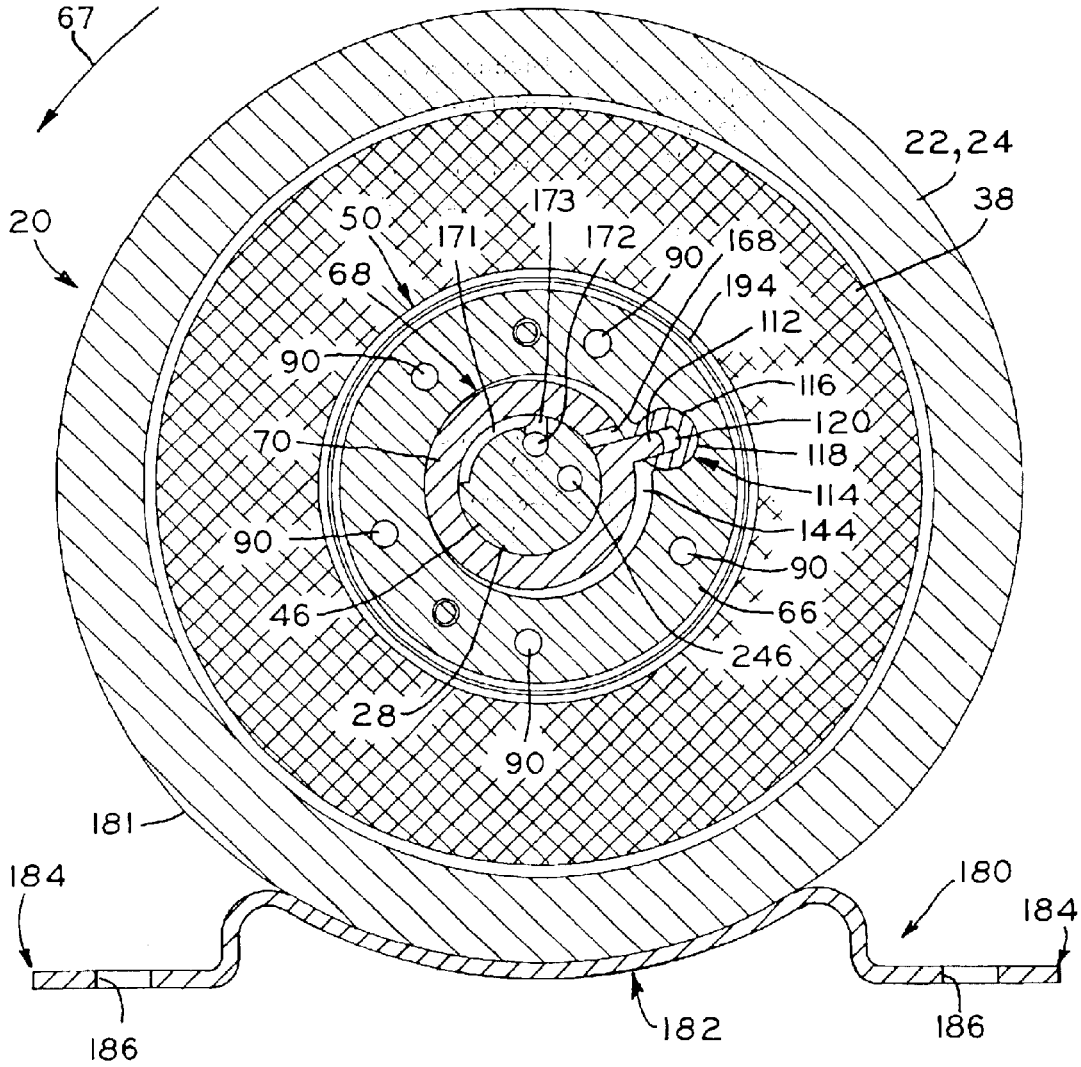
FIG. 4 is a sectional view of the rotary compressor of FIG. 1 along line 4—4.

During compressor operation, a portion of roller 70 engages the wall of inner cylindrical cavity 68 formed in cylinder block 66 with the remainder of the perimeter of roller 70 being separated from the wall of inner cavity 68 (FIGS. 2, 3 and 4). Vane 112 is integrally formed with roller 70 and extends radially therefrom. Vane 112 is received in guide assembly 114 mounted in cylinder block 66 to drive roller 70 and form radial abutment between cylinder block 66 and roller 70, thereby driving first and second compression mechanisms 48 and 50. Guide assembly 114 includes cylindrical bushing 116 located in cylindrical recess 118 formed in cylinder block 66 adjacent the wall of inner cylindrical cavity 68. Bushing 116 is provided with longitudinally extending slot 120 in which the end of vane 112 is slidably received. Cylindrical bushing 116 can be made from any suitable material possessing adequate anti-friction properties. One such material includes VESPEL SP-21, which is a rigid resin material available from E.I. DuPont de Nemours and Company. By using a material having anti-friction properties, the frictional losses caused by sliding movement of vane 112 in slot 120 and circumferential movement of bushing 116 in recess 118 of the cylinder block 66 are reduced. Further, the wear between interfacing surfaces of vane 112 and recess 118 as well as the interfacing surfaces between cylindrical bushing 116 and cylinder block 66 is reduced, thereby improving reliability of compressor 20.

As rotor 40 rotates under the influence of magnetic forces acting between stator 38 and rotor 40, cylinder blocks 66 and outboard bearings 78 and 80 rotate with bearing assemblies 98 and 100 around shaft axis 52. The engagement of vane 112 with slot 120 in bushing 116 causes rollers 70 to rotate about the axis of shaft eccentric portions 44 and 46 in sync with the rotation of cylinder blocks 66. Rollers 70 eccentrically revolve in cylinder blocks 66 and perform the compressive pumping action of compressor 20. Axial movement of the assembly including rotor 40 and compression mechanisms 48 and 50 is limited at one end by thrust bearing 122 supported by oil pump 124. The axial movement is limited at the opposite end by thrust bearing 126 supported by round wire spring 128. Spring 128 may be, for example, a WAWO spring from Smalley Steel Ring Company located in Lake Zurich, Ill., U.S.A.

A fluid flow path is provided through compressor 20 along which refrigerant fluid, acted on by first and second stage compression mechanisms 48 and 50, travels through the compressor. Referring to FIG. 1, suction inlet 130 is mounted in one end cap 26 by a method such as welding, brazing, or the like. Suction pressure refrigerant enters suction inlet 130 and flows through cavity 132 defined between end 30 of shaft 28 and the bottom of recess 34 into longitudinally extending bore 134 formed in shaft 28. As shown in FIG. 2, a plurality of radial passages 136 extend outwardly from bore 134 and are in fluid communication with annular channel 138 formed about the periphery of eccentric portion 44 of first stage compression mechanism 48. Channel 138 is in constant fluid communication with radial channel 140 passing through the wall of roller 70. Channel or passage 140 is located on one side of vane 112 and directs the refrigerant to crescent shaped compression space 144 defined between cylinder block 66 and roller 70 where the refrigerant is compressed to a second, intermediate pressure.

Figure 6:
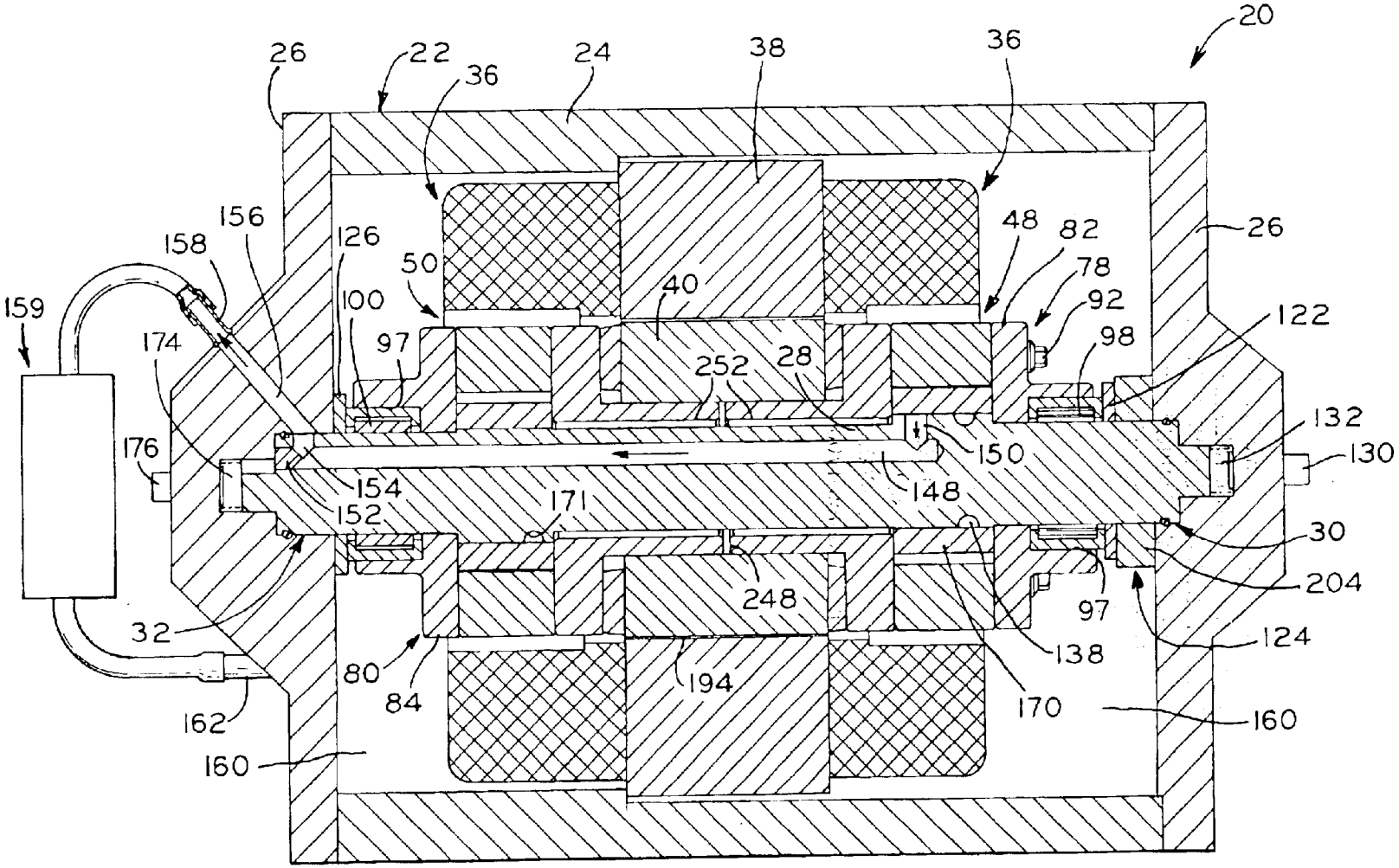
FIG. 6 is an additional sectional view of the rotary compressor in accordance with the present invention.
Figure 8A:
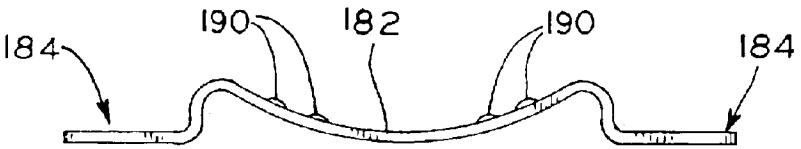
FIG. 8A is an end view of a mounting assembly for the rotary compressor of FIG. 1.
Figure 8B:
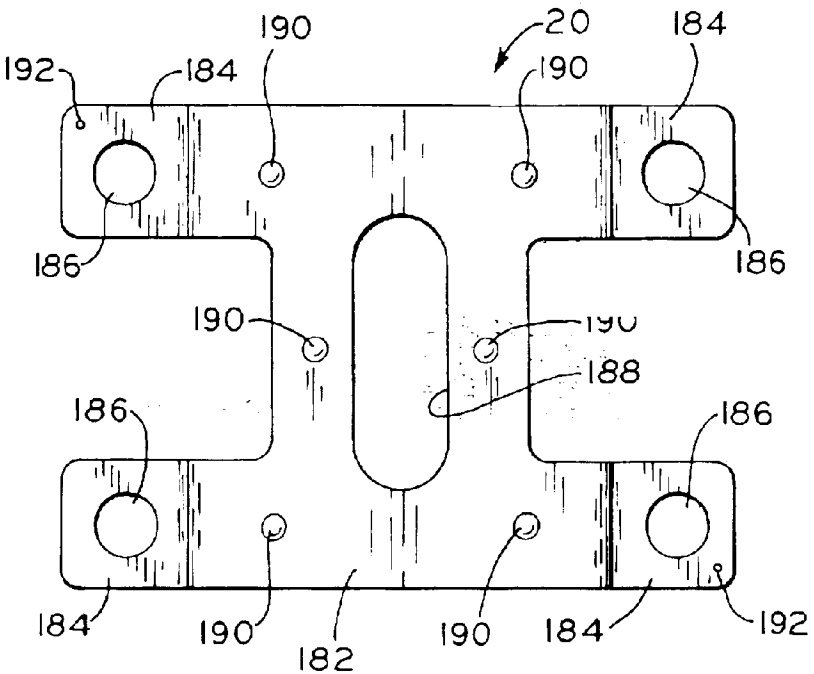
FIG. 8B is a top plan view of the mounting assembly of FIG. 8A.
Figure 7A:
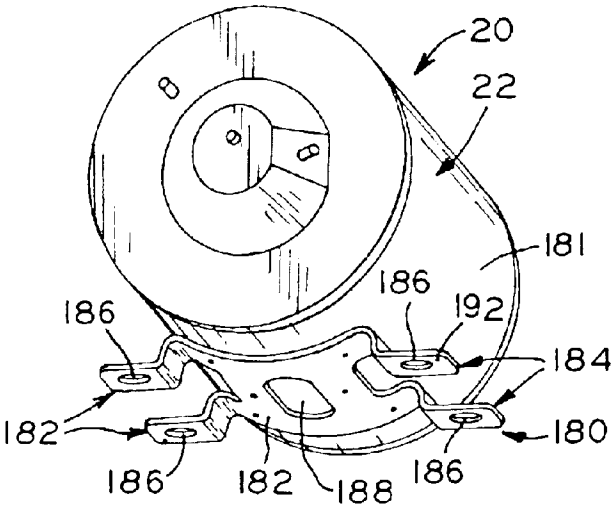
FIG. 7A is a perspective view of the rotary compressor and mounting assembly assembled to one another in accordance with the present invention.
Figure 7B:
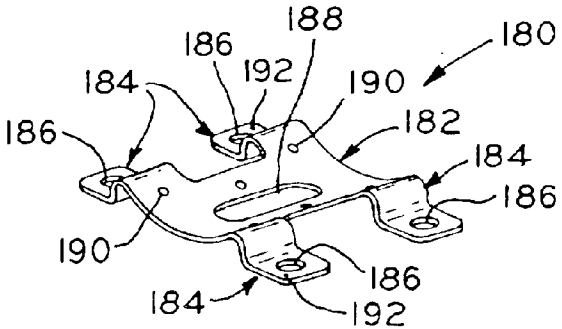
FIG. 7B is a perspective view of the mounting assembly of the present invention.
Figure 9A:
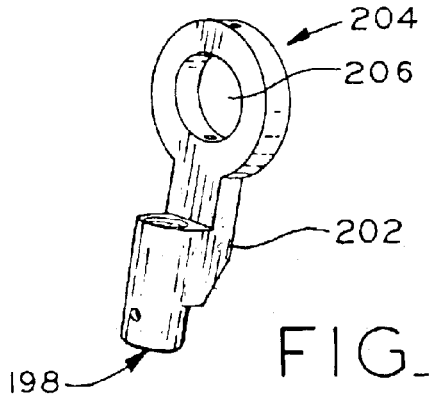
FIG. 9A is a perspective view of a lug of a pump assembly in accordance with the present invention.
Figure 9C:
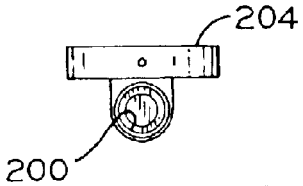
FIG. 9C is a top view of the lug of FIG. 9B.
Figure 9B:
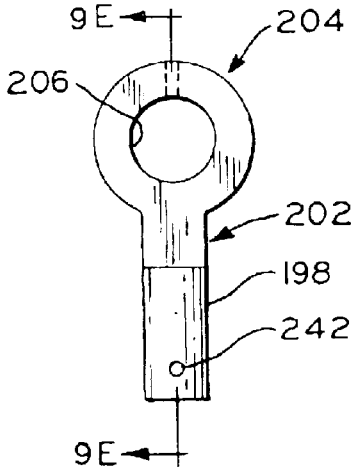
FIG. 9B is a front view of the lug of FIG. 9A.
Figure 9E:
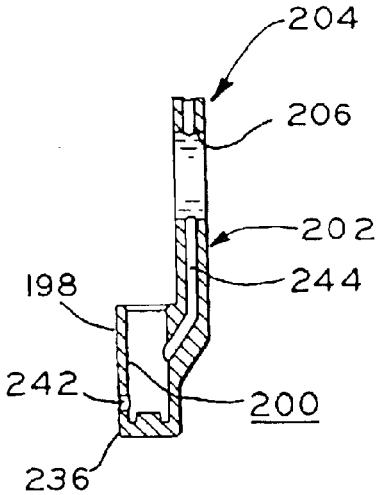
FIG. 9E is a sectional view of the lug of FIG. 9B taken along line 9E—9E.
Figure 9D:
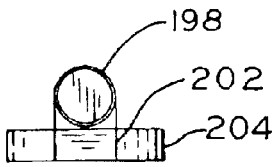
FIG. 9D is a bottom view of the lug of FIG. 9B.
Figure 10A:
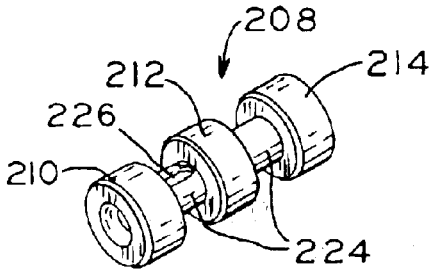
FIG. 10A is a perspective view of a piston of the pump assembly of the present invention.
Figure 10B:
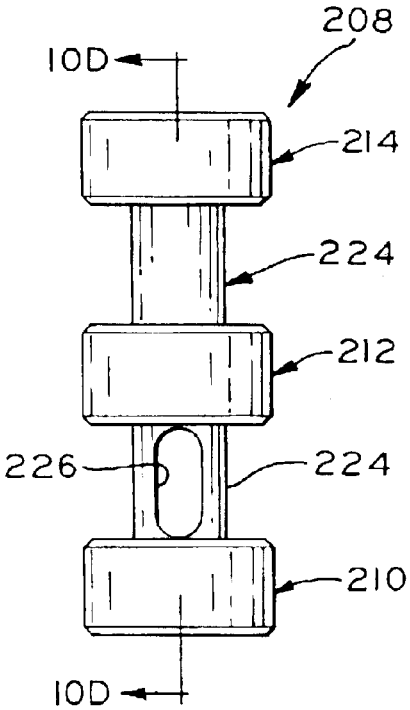
FIG. 10B is an elevational view of the piston of FIG. 10A.
Figure 10D:
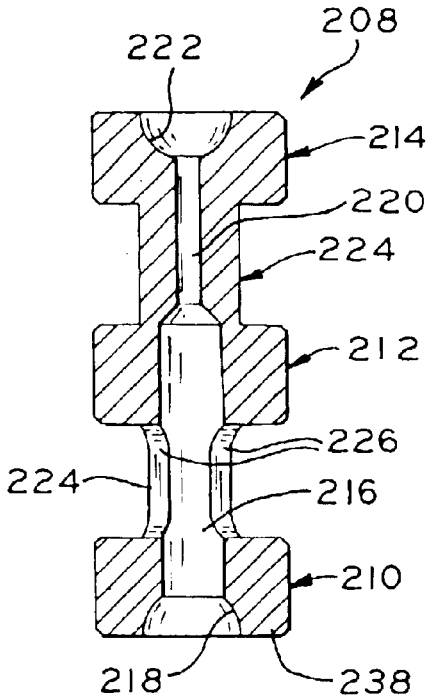
FIG. 10D is a sectional view of the piston of FIG. 10B taken along line 10D—10D.
Figure 10C:
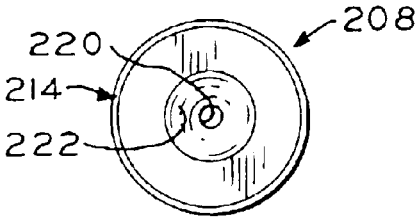
FIG. 10C is a top view of the piston of FIG. 10B.

Referring to FIG. 3, the compressed fluid is exhausted from compression space 144 of first stage compression mechanism 48 through radial passage 170. Passage 170 is located adjacent to the side of vane 112 opposite to the side of vane 112 on which passage 140 is formed. Fluid in passage 170 enters recess 146 extending about a portion of the periphery of eccentric portion 44. As shown in FIG. 6, recess 146 is fluidly connected by radial channel 150 to a second longitudinal bore 148 extending through shaft 28. Referring to FIG. 6, the end of bore 148 near end 32 of shaft 28 is provided with plug 152 to prevent the fluid from exiting bore 148 and to direct flow into radial passage 154. The intermediate pressure refrigerant flows through passage 154 into channel 156 formed in end cap 26 and out of compressor housing 22 through discharge outlet 158. The discharged intermediate pressure fluid enters unit cooler 159, schematically shown in FIG. 6. Unit cooler 159 is located outside of compressor casing 22 where it is cooled before being introduced into motor and oil sump cavity 160 through fitting 162. The cooled, intermediate pressure refrigerant gas in cavity 160 flows around and cools motor 36. By cooling the intermediate pressure gas, heat from the first stage discharge gas is not transferred to the lubricant in motor and oil sump cavity 160 and to the suction pressure gas entering first stage compression mechanism 48 due to a small temperature difference between the fluids.

The cooled, intermediate pressure refrigerant gas is introduced into second stage compression mechanism 50 through inlet port 164 (FIG. 1) formed in flange 84 of outboard bearing 80. Baffle 166 is provided with an opening (not shown) facing a direction opposite to the direction of rotation of rotor 40. Baffle 166 is mounted to outboard bearing 80 in alignment with inlet port 164 to protect against direct suction of oil into second stage compression mechanism 50. After the cooled, intermediate pressure refrigerant gas is compressed in second stage compression mechanism 50 to a higher discharge pressure, the discharge pressure gas is discharged into radial passage 168 formed in roller 70 adjacent to one side of vane 112. The discharge pressure gas then flows through recess 171 extending about a portion of the periphery of shaft 28 and radial passage 173 into longitudinally extending bore 172 formed in shaft 28 extending from compression mechanism 50 to shaft end 32. Referring to FIG. 1, the discharge pressure gas exits compressor 20 and flows into cavity 174 formed between end 32 of shaft 28 and the bottom of recess 34 in end cap 26. The fluid in cavity 174 then flows through discharge port 176 to the remainder of the refrigeration system.

The suction conduits and passages of the fluid flow system of compressor 20 are located on one side of shaft 28 and the discharge channels and conduits are located on the opposite side of the shaft to prevent overheating of the incoming suction pressure gas. Static O-ring seals 178 are positioned about each end 30 and 32 of shaft 28, between the shaft and end cap recess 34. Seals 178 prevent leakage of the pressurized refrigerant gas between suction and discharge pressure cavities 132 and 174 and intermediate pressure motor and oil sump cavity 160.

Compressor 20 is also provided with a lubricating fluid flow path through which lubricating oil accumulated in the lower portion of motor and oil sump cavity 160 is directed to the compressor components. Referring to FIGS. 1, and 9A through 9E, located in the lubrication flow path is positive displacement, reciprocating piston type oil pump 124 including a pump barrel 198 having a finely machined or polished inner cylinder surface 200. Oil pump 124 further includes lug 202 integrally formed on one side of pump barrel 198. Lug 202 extends upwardly from sump 160 and has ear 204 formed at the exposed end thereof. Circular opening 206 is formed in ear 204 for mounting oil pump 124 onto stationary shaft 28.

Piston 208 has a substantially tubular configuration as shown in FIGS. 1, and 10A through 10D to be received in barrel 198. Piston reciprocates within barrel 198 to induce pumping action of pump 124. Piston 208 includes enlarged annular portions 210, 212, and 214, each having an outside diameter substantially equal to the inner diameter of barrel 198 to establish a sealed relationship between reciprocating piston 208 and cylindrical surface 200 of barrel 198. Piston 208 is provided with axial channel 216 having semispherical cavity 218 formed in one end thereof and a smaller diameter axial oil passage 220 extending from the internal end of channel 216. Passage 220 is in fluid communication with semispherical cavity 222 formed at the opposite end of piston 208 from cavity 218 such that cavities 218 and 222 are in fluid communication. Piston 208 is also formed having a pair of smaller diameter portions 224 with one smaller diameter portion 224 being located between each of pair of enlarged portions 210 and 212, and 212 and 214. A plurality of ports 226 are formed in the smaller diameter portions 224 located between enlarged portions 210 and 212 in fluid communication with axial channel 216. Ports 226 may be formed by a plurality of elongated slots extending substantially parallel to the longitudinal axis of piston 208.

Referring to FIG. 1, reciprocating movement of piston 208 is provided by the eccentricity of projection 94 of outboard bearing 78, which rotates about fixed shaft 28. Projection 94 acts as a cam, which communicates motion to follower or piston 208 through roller or ball 228 located in semispherical cavity 222. Ball 228 slides on cam surface 230 in curved race or groove 232 formed in the outer surface of projection 94 to reduce the compressive stress between the ball and cam surface. The advantage of this method of creating reciprocating movement of piston 208 is that the amount of initial friction between ball 228 and cam surface 230 is only slightly larger than the operating friction of pump 124.

Annular compression spring element 234 is interposed between end 236 of oil pump barrel 198 and flange structure 238 defined at end 240 of piston 208 to keep ball 228 in constant contact with cam surface 230. Fluid end 236 of oil pump barrel 198 is provided with input port 242 bored therein. Input port 242 is located below oil surface level 196 in oil sump 160, in fluid communication with the oil stored therein.

Discharge manifold 244 is formed in lug 202 of pump barrel 198 and is in fluid communication with longitudinally extending bore 246 formed in shaft 28 via radial passage 247. Radially extending oil passages 248 (FIG. 1) extend from longitudinal channel 246 to distribute lubrication to the bearings of the compressor. The reciprocating movement of piston 208 causes the volume of chamber 250 defined in barrel 198 between its end 236 and end 240 of piston 208 to vary, enabling pumping of the lubricating oil. As piston 208 moves upwardly toward shaft 28, the sealed relationship between inner cylindrical surface 200 of barrel 198 and the outer diameter of enlarged portion 210 creates a vacuum which draws lubricant in motor and oil sump cavity 160 through input port 242 and into chamber 250. As piston 208 moves downwardly, away from shaft 28, spring element 234 is compressed and the gaps between the spring windings are reduced. The compressed spring element 234 at least partially blocks input port 242 to restrict backflow of the lubricating oil located in pump chamber 250 toward motor and oil sump cavity 160. As spring element 234 is compressed, oil is forced out of chamber 250 and flows upwardly through semispherical cavity 218, axial passage 216, and the plurality of ports 226 into discharge manifold 244. The oil in manifold 244 then flows into channel 246 in shaft 28 and through radial oil passages 248 to lubricate the compressor bearings. After the down-stroke of piston 208 is complete, the piston moves upwardly within pump barrel 198 under the influence of spring 234, reducing the amount of pressure acting on oil remaining in chamber 250 and allowing additional oil to be drawn into chamber 250 to repeat the lubricating process.

A portion of the oil in chamber 250 flowing into discharge manifold 244 travels upwardly into passage 220. Lubricating oil from motor and oil sump cavity 160 is supplied to the surfaces of ball 228 and semispherical cavity 222 through passage 220 to reduce friction therebetween. As ball 228 rotates, oil from passage 220 is carried on the outer surface thereof to lubricate the interfacing surfaces between ball 228 and cam surface 230.

Oil pump 124 may be mounted on either end of shaft 28 due to similarity in eccentricity of projections 62 and 64. Alternatively, two oil pumps may be installed in the compressor for improving lubrication under extremely difficult conditions such as when, for example, high viscosity oil is required for lubrication.

The location of the pumping chamber and oil inlet being below oil level 196 of oil in motor and oil sump cavity 160 prevents "gas lock" conditions. Such a condition might otherwise occur when the piston element cycles normally, but oil cannot be pumped because there is gas captured in chamber 250. Piston movement would then merely cause compression and expansion of the gas within pumping chamber 250, and thus no oil would be pumped to the bearing surfaces. Further, by locating oil pump 124 at its shown location in the present invention, rather than at the end of the stationary shaft, the length of housing 22 is reduced by the amount otherwise used to accommodate the pump and oil pick up tube.

In some compressors, lubricating oil tends to drain away from bearing surfaces upon shutdown of the compressor. Upon startup of the compressor, there may be a delay before oil can be resupplied to the bearings. In order to prevent the lubrication delay, compressor 20 is provided with reservoir 252, as shown in FIG. 1, defined by a gap located between the inner surface of aperture 42 in rotor 40 and the outer surface of shaft 28. Reservoir 252 is a hollow cylindrical cavity in which oil is received from oil supply bore 246 via radially extending passages 254. Oil in reservoir 252 is then supplied to eccentrics 44 and 46 and rollers 70 for lubrication thereof.

The total volume of reservoir 252 can be found using the following equation:

$$V_0=\pi t(R^2-r^2)$$

where t is the distance between facing inner planes of the eccentrics 44 and 46 (cm); r is radius of shaft 28 (cm); and R is radius of the inner wall surface of aperture 42 in rotor 40 defining a portion of reservoir 252 (cm). Reservoir 252 is charged with a predetermined amount of lubricant during assembly of compressor 20 which may be approximately ⅓ $V_0$.

A small portion of the initial assembly charge of lubricant in reservoir 252 will leak therefrom before startup of compressor 20 through capillary seals, or seals formed by an oil film located between closely toleranced parts. Capillary seals may be formed between eccentrics 44 and 46 and rollers 70, rollers 70 and outboard bearings 78 and 80, and rollers 70 and heads 54 and 56. In the present example, the capillary seals may be in a range of 0.0003 and 0.0007 inches thick. The amount of oil that leaks axially along shaft 28, past the capillary seals, when the compressor is at rest can be calculated from the following equation:

$$Q_0=2\pi Rh^3\Delta P/(12\ \mu_0 t)$$

where h is the thickness of the capillary seal (cm); $\mu_0$ is viscosity of the oil (centipoise); and ΔP is the pressure difference across the seal, which is considered to be substantially 1 psi. Therefore, by dividing amount of oil charged in reservoir 252 by the amount of initial oil leakage, a length of time can be determine in which the compressor will loose the entire initial charge of oil. A rise of the temperature and pressure during compressor operation affects the viscosity of the lubricating oil and, thus, the leakage through the capillary seals. The leakage can be computed by the following equation:

$$Q=(2\pi Rh^3/12\ \mu t)[(1-e^{-B\Delta p})/B]$$

where B is empirical constant equal to approximately $2.2\times 10^{-4}$; $\mu$ is the viscosity of the oil at 100° F. (centipoise); and Δp is a pressure differential across the seal (psi). The length of time in which the compressor will loose the initial assembly oil charge can be determined by dividing the initial volume of oil in reservoir 252 by the leakage after startup. Therefore, if lubrication can be supplied to bearing surfaces upon compressor startup, until lubricant from motor and oil sump cavity 160 can be delivered by pump 124 to the bearing surfaces, then the initial volume of oil in reservoir 252 satisfies the lubrication needs of the compressor.

During operation of compressor 20, some of the initial oil charge and oil supplied through the passage 254 to reservoir 252 is distributed under centrifugal force toward rollers 70 and the surfaces of eccentrics 44 and 46 facing reservoir 252. Upon shutdown of compressor 20, oil which accumulates on the cylindrical surfaces defining reservoir 252, oil captured in passage 254, and any oil remaining in reservoir 252 accumulates at the bottom of reservoir 252 to be immediately distributed to bearing surfaces when the compressor is again restarted.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hermetic rotary compressor, comprising:

a housing;

a stationary shaft fixedly mounted in said housing;

a motor mounted in said housing, said motor having a rotor and a stator, said rotor having a first and second end and being rotatably mounted on said shaft; and first and second rotary compression mechanisms rotatably mounted on said shaft, each of said first and second rotary compressions mechanisms including a roller, a cylinder and a vane operably coupling said roller and said cylinder, said first compression mechanism located adjacent said first end of said rotor, and said second compression mechanism located adjacent said second end of said rotor, said compression mechanisms operatively engaged with said rotor, whereby rotation of said rotor drives said compression mechanisms about said stationary shaft.

2. The rotary compressor of claim 1, wherein said housing includes a main body portion and a pair of end caps fixedly secured to opposite ends of said main body portion, said stationary shaft having two ends, each of said shaft ends mounted in one of said end caps.

3. A hermetic rotary compressor, comprising:

a housing;

a stationary shaft fixedly mounted in said housing;

a motor mounted in said housing, said motor having a rotor and a stator, said rotor having a first and second end and being rotatably mounted on said shaft;

first and second compression mechanisms rotatably mounted on said shaft, said first compression mechanism located adjacent said first end of said rotor, and said second compression mechanism located adjacent said second end of said rotor, said compression mechanisms operatively engaged with said rotor, whereby rotation of said rotor drives said compression mechanisms about said stationary shaft; and two eccentrics integrally formed on said stationary shaft, said first and second compression mechanisms each containing a said eccentric, each said compression mechanism having a compression chamber, the volume of which being varied with the angular position of said compression mechanism relative to its said eccentric.

4. The rotary compressor of claim 3, wherein said compression mechanisms each include a head having a flange portion and a projection, said rotor fixedly secured to said projections, whereby a head and rotor assembly is formed, said heads and rotor assembly rotatably mounted about said stationary shaft.

5. The rotary compressor of claim 4, wherein said compression mechanisms each include a roller journaled on its respective said shaft eccentric and a cylinder block rotatably mounted about said roller, said roller having a vane integrally formed therewith engaging said cylinder block, said roller and said cylinder block located adjacent said head.

6. The rotary compressor of claim 4, wherein each said compression mechanism further includes an outboard bearing, said outboard bearing rotatably mounted on said stationary shaft adjacent said roller and said cylinder block, said outboard bearing, said cylinder block, and said head secured to one another via a fastener.

7. The rotary compressor of claim 6, further comprising a thrust bearing mounted at one end of said stationary shaft, one of said outboard bearings being biased into engagement with said thrust bearing.

8. The rotary compressor of claim 6, further comprising an oil pump mounted at one end of said stationary shaft, and a thrust bearing in contact with one of said outboard bearings and said oil pump.

9. The rotary compressor of claim 4, further comprising a reservoir defined between said head and rotor assembly and said stationary shaft, said reservoir having oil stored therein, said stored oil being available to lubricate said compressor assembly immediately upon compressor startup.

10. A hermetic rotary compressor, comprising:

a housing;

a stationary shaft fixedly mounted in said housing and having first and second ends;

a motor mounted in a motor chamber defined in said housing, said motor having a stator and a rotor, said rotor having opposite ends and rotatably mounted about said stationary shaft;

a first and a second stage compression mechanism, said compression mechanisms fixed to opposite ends of said rotor;

a first longitudinal bore extending from said first end of said stationary shaft to said first stage compression mechanism, said first longitudinal bore in fluid communication with said first stage compression mechanism via a first radial passage; and a second radial passage extending between said first stage compression mechanism and a second longitudinal bore formed in said stationary shaft, said second longitudinal bore having a discharge port in fluid communication said motor chamber;

said motor chamber and said second stage compression mechanism in fluid communication, said second stage compression mechanism in fluid communication with a third longitudinal bore formed in said stationary shaft via a third radial passage, said third longitudinal bore extending from said second stage compression mechanism to said second end of said stationary shaft, compressed refrigerant exhausted from said compressor through said stationary shaft second end.

11. The rotary compressor of claim 10, further comprising a first and second cavity defined by said first end of said stationary shaft and said housing, said first and second cavities in fluid communication with said first and third longitudinal extending bores, respectively.

12. The rotary compressor of claim 10, further comprising an outboard bearing located adjacent said second stage compression mechanism, said motor chamber and said second stage compression mechanism in fluid communication via a passage extending through said outboard bearing.

13. The rotary compressor of claim 10, wherein said first stage compression mechanism further includes a cylinder block and a roller, said roller having a vane integrally formed therewith, said vane engaging said cylinder block, said first radial passage located adjacent a first side of said vane, and said second radial passage located adjacent a second side of said vane.

14. The rotary compressor of claim 10, wherein said refrigerant gas entering said first stage compression mechanism is at a first, suction pressure and said refrigerant gas exhausted from said first stage compression mechanism is at a second, intermediate pressure.

15. The rotary compressor of claim 14, wherein said intermediate pressure refrigerant gas enters said motor chamber, said motor being cooled by said intermediate pressure gas.

16. The rotary compressor of claim 15, further comprising a unit cooler, said intermediate pressure gas being cooled in said unit cooler before entering said motor chamber.

17. The rotary compressor of claim 15, wherein said intermediate pressure is drawn into said second stage compression mechanism, said intermediate pressure gas being compressed to a third, discharge pressure in said second stage compression mechanism.

18. The rotary compressor of claim 10, further comprising an annular seal located between said stationary shaft and said housing, whereby fluid leakage between said stationary shaft and said housing is prevented.

19. A hermetic rotary compressor, comprising:

a housing having an outer surface;

an oil sump defined in said housing;

a stationary shaft fixedly mounted in said housing;

a motor mounted in said housing, said motor having a stator and a rotor, said rotor rotatably mounted about said shaft;

first and second compression mechanisms rotatably mounted at opposite ends of said rotor and operatively engaged with said rotor; and a mounting plate attached to said outer surface of said housing, said compressor mounted in one of a substantially horizontal and vertical orientation.

20. The rotary compressor of claim 19, wherein said mounting plate further includes a base having a plurality of extension legs extending therefrom.

21. The rotary compressor of claim 20, wherein said extension legs are provided with at least one aperture for mounting said compressor.

22. The rotary compressor of claim 20, wherein said base is provided with an opening therein, said opening exposing a portion of said outer surface of said housing.

23. The rotary compressor of claim 19, wherein said mounting plate is mounted to said housing by projection welding.

24. The rotary compressor of claim 19, further compressing an oil pump mounted to said stationary shaft such that in each of said substantially horizontal and vertical orientations, said oil pump is at least partially submersed in said oil sump.

* * * * *